United States Patent [19]

Gagas

[11] Patent Number: 4,559,703

[45] Date of Patent: Dec. 24, 1985

[54] PROCESS FOR SILVER PLATING ROTARY CONTACT ASSEMBLIES

[75] Inventor: Donald F. Gagas, Milwaukee, Wis.

[73] Assignee: Centralab, Inc., Milwaukee, Wis.

[21] Appl. No.: 603,526

[22] Filed: Apr. 24, 1984

[51] Int. Cl.[4] ..... H01R 43/00

[52] U.S. Cl. ..... 29/876; 29/885; 200/303; 427/125

[58] Field of Search ..... 29/876, 877, 884, 885; 200/266, 267, 273, 274, 303; 427/125

[56] References Cited

U.S. PATENT DOCUMENTS

| | | | |
|---|---|---|---|
| 2,298,236 | 10/1942 | Siegmund | 200/267 X |
| 2,771,380 | 11/1956 | Coleman et al. | 427/125 |
| 3,219,785 | 11/1965 | Allison | 29/874 X |
| 3,476,530 | 11/1969 | Ehrreich et al. | 427/125 X |
| 3,525,827 | 8/1970 | Allison . | |
| 4,070,752 | 1/1978 | Robinson | 29/885 X |
| 4,450,188 | 5/1984 | Kawasumi | 427/125 X |

*Primary Examiner*—Howard N. Goldberg
*Assistant Examiner*—Carl J. Arbes
*Attorney, Agent, or Firm*—Jack E. Haken; James J. Cannon, Jr.

[57] ABSTRACT

A process for silver plating a rotary switch contact assembly wherein a brass metal plate and a plastic rotor retainer are first formed, force-fitted together and then silver-plated as an assembly.

1 Claim, 4 Drawing Figures

FIG. 1
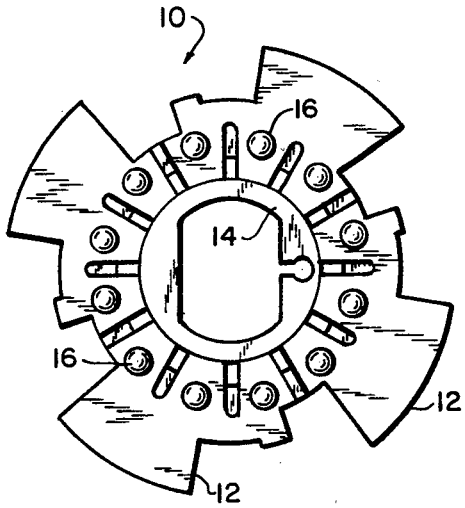
FIG. 2
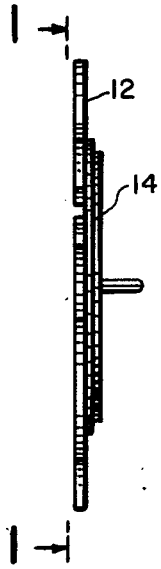
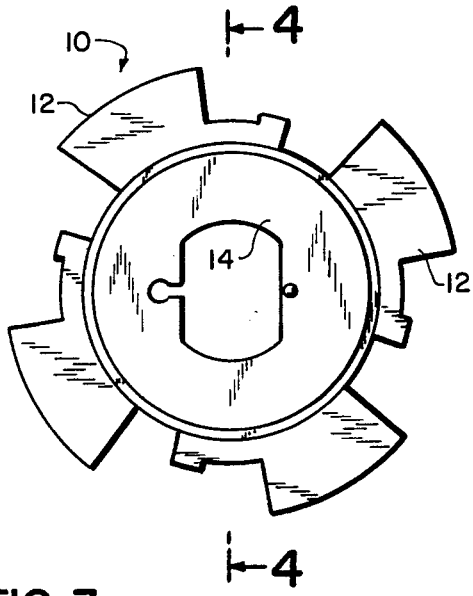
FIG. 3
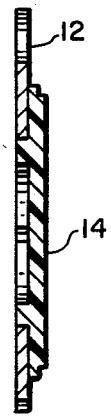
FIG. 4

PROCESS FOR SILVER PLATING ROTARY CONTACT ASSEMBLIES

FIELD OF THE INVENTION

This invention pertains to rotary contact assemblies for use in miniature rotary switches.

DESCRIPTION OF THE PRIOR ART

Rotary contact assemblies have been made by a variety of prior processes. The most common of these was the use of a stock piece preplated with silver and having a force fitted plastic retainer used to position the rotor. The use of preplated stock has been accompanied by several problems. Among others, the cost of silver-plated stock and the waste in forming the rotor contacts has been very high. Problems in performance have also been encountered. The present invention is directed to overcoming the problems with the prior art assemblies.

SUMMARY OF THE INVENTION

The process of the present invention substitutes the use of a brass base material for a preplated stock plate for the rotary contact in a rotary switch assembly. The brass base material is stamped to shape and a plastic rotor retainer is force fitted in assembly. The brass used is a CDA 260, full hard. The plastic utilized is Lexan TM. After assembly of the stamped brass base material and Lexan rotary retainer, the entire assembly is plated with silver. The silver plating is done a type of fine silver common to most conventional silver plating baths. The procedure involves plating a large quantity of pieces in a barrel using 5 mm electroless copper plated plastic balls as fillers, at a current of 40 to 50 amps and a cycle time of 20 to 25 minutes. At the conclusion of the process there is an even distribution of fine silver covering all areas of brass with excellent adhesion and ductablility. The overall thickness of the silver plating on the brass is consistent and within specifications for the desired switch. None of the silver is deposited on the Lexan in the assembly. The use of the process eliminates significant waste of preplated silver-plate stock and provides a significant cost reduction.

BRIEF DESCRIPTION OF THE DRAWINGS

FIG. 1 is a plan view of one side of the rotor assembly of the present invention.

FIG. 2 is a plan view of the reverse side of the rotor assembly of the present invention.

FIGS. 3 and 4 are cross-sectional views of the rotor assemblies of FIGS. 1 and 2 respectively.

DESCRIPTION OF THE PREFERRED EMBODIMENT

Referring now to the drawings, the rotor assembly 10 of the present invention constitutes a metallic contact piece 12 and a plastic retainer piece 14. The contact piece 12 is a brass base material, the brass being a CDA 260, full hard. From this brass piece, a contact form is stamped to yield a rotary contact of the desired shape and size for a particular rotary switch. A piece of molded plastic 14 is shaped to provide a rotor retainer including dimples 16 which may be force fitted into openings of plate 12. The plastic used in retainer 14 is preferably Lexan. After the rotor retainer 14 is force fitted into plate 12, a rotary contact assembly is effected. The entire assembly is then silver-plated. The silver plating process uses a type of fine silver common to most conventional to silver plating baths. In practice, this procedure would involve plating 5,000 to 25,000 pieces in a barrel using 5 mm electroless copperplated plastic balls as fillers, at a current of 40 to 50 amps and a cycle time of 20 to 25 minutes. After the rotary contact assemblies 10 are removed from the bath, there is an even distribution of a fine silver plating covering all the exposed areas of the brass with excellent adhesion and ductility. The overall thickness of the silver plating is consistent and meets the specifications for a rotary contact assembly for various rotary switches. The process of the present invention eliminates preplated silver stock and eliminates the waste associated with stamping silver-plated stock to a desired shape.

The resulting cost savings can be as much as 54% of the former cost.

When the entire rotor assembly 10 consisting of brass material and lexan material is removed from the bath, no silver is deposited on the plastic part 14.

I claim:

1. The process of making a rotary switch contact assembly comprising the steps of:

(1) stamping a piece of hard brass plate to a desired shape;

force fitting a molded plastic rotor retainer piece into said stamped contact plate;

immersing said assembly of rotor retainer and contact plate in a silver plating bath having a fine silver and also having 5 mm electroless copper-plated plastic balls as fillers;

applying a current of 40 to 50 amps for a cycle time of 20 to 25 minutes;

removing said rotor assemblies from said bath.

* * * * *